United States Patent [19]

Loch

[11] 4,028,789

[45] June 14, 1977

[54] METHOD OF INSTALLING A SLEEVE IN ONE END OF A TUBE

[75] Inventor: Emil P. Loch, Tampa, Fla.

[73] Assignee: Westinghouse Electric Corporation, Pittsburgh, Pa.

[22] Filed: Mar. 29, 1976

[21] Appl. No.: 671,885

[52] U.S. Cl. ..... 29/157.4; 29/401 R; 29/421 E; 228/2.5; 228/107

[51] Int. Cl.[2] ..... B21D 39/06; B23P 15/26

[58] Field of Search ..... 29/401 R, 421 E, 157.3 C, 29/157.4, 402, 421 R, 401 D; 228/107, 108, 109, 245, 246, 2.5

[56] References Cited

UNITED STATES PATENTS

| | | | |
|---|---|---|---|
| 2,620,830 | 12/1952 | Schultz | 138/97 |
| 3,411,198 | 11/1968 | Berman et al. | 29/523 X |
| 3,562,887 | 2/1971 | Schroeder et al. | 29/157.4 |
| 3,590,877 | 7/1971 | Leopold et al. | 228/2.5 X |
| 3,698,067 | 10/1972 | Feiss | 29/470.1 |

*Primary Examiner*—Victor A. DiPalma
*Attorney, Agent, or Firm*—F. J. Baehr, Jr.

[57] ABSTRACT

Method for explosively expanding sleeves into heat exchanger tubes disposed in a tube sheet utilizing shaped charges in conjunction welding and brazing techniques to affectuate tube modifications and repairs including the steps of shaping the sleeve, placing specially shaped inserts into the sleeves, varying the explosive charges within the inserts and varying the confinement of the explosive charge within the insert to explosively weld the sleeve to the tube, expand the sleeve to the tube, and/or expand the tube to engage the tube sheet and welding or brazing one end of the sleeve to the tube to form a seal.

18 Claims, 9 Drawing Figures

METHOD OF INSTALLING A SLEEVE IN ONE END OF A TUBE

BACKGROUND OF THE INVENTION

This invention relates to installing sleeves in heat exchanger tubes and, more particularly, to the utilization of shaped explosive charges to weld portions of the sleeves to portions of the tube within the tube sheet and to expand portions of the sleeve to portions of the tube beyond the tube sheet.

Heat exchanger tubes fail in service from highly localized defects with the remainder of the tube in essentially perfect condition. Often, it is impractical or untimely to replace defective tubes and the tube is removed from service by plugging, thereby ending its useful life. If a large number of tubes are plugged, the efficiency of the heat exchanger may be reduced to such an extent that the usefulness of the heat exchanger is impaired. Besides repairing defective tubes, sleeves may also be utilized to lower the heat flux through a portion of the tube wall by increasing the effective tube wall thickness and to control the fluid velocity by restricting the opening at the mouth of the tube.

Thus, sleeves are effective devices for repairing and modifying the heat flux and flow velocities in heat exchange tubes and properly shaped and properly disposed explosive charges facilitiate the installation of sleeves in tubes of heat exchangers.

SUMMARY OF THE INVENTION

In general, a method of installing a sleeve in one end of a tube disposed in the tube sheet of a heat exchanger, when performed in accordance with the steps of this invention, comprises forming the sleeve so that it has an outer diameter sufficiently smaller than the inside diameter of the tube to provide an annular space therebetween, flaring one end of the sleeve to such an extent that the flared end is larger in diameter than the inside diameter of the tube and inserting the sleeve in one end of the tube so that the flared end wedges itself against the tube to position the sleeve in the tube and to form an annular space therebetween. This method also includes the steps of forming an insert of resilient material so that the insert fits snugly within portions of the sleeve and has a relatively large diameter cylindrical chamber disposed adjacent the flared end of the sleeve and a smaller diameter chamber extending from the large diameter chamber and extending away from the flared end of the sleeve, placing explosive materials in said chambers and detonating the explosive material, whereby the flanged end of the sleeve is explosively welded to the tube and the sleeve adjacent the smaller diameter cylindrical chamber is explosively expanded into engagement with the tube. With the sleeve expanded into engagement with the tube, a metallurgical bond is formed between the sleeve and the tube on the end of the sleeve opposite the flared end of the tube by heating that end of the tube.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
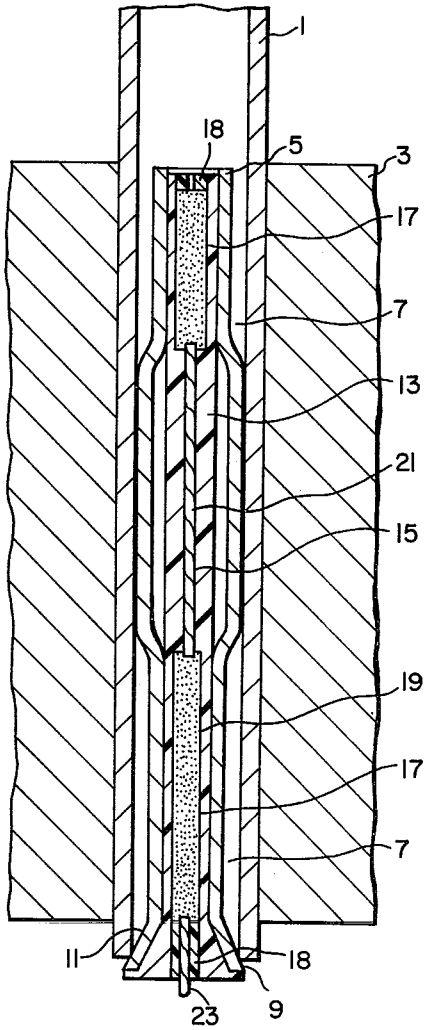
FIG. 1 is a partial sectional view of a sleeve showing an insert and the disposition of explosive charges within the insert.

Referring now to the drawings in detail, and in particular to FIG. 1, there is shown a tube 1 disposed in a tube sheet 3 and a sleeve 5 disposed within the tube 1.

The sleeve 5 is formed to have an outside diameter sufficiently smaller than the inside diameter of the tube 1 to provide an annular space 7 between the sleeve 5 and the the tube 1. One end 9 of the sleeve 5 is flared outwardly to such an extent that the flared end 9 is larger in diameter than the inside diameter of the tube 1. The flared end 9 is provided with a taper 11 which wedges itself against the inside surface of the tube 1 to position the sleeve 5 to form an annular space 7 between the sleeve 5 and the tube 1 of the proper size to effectuate explosively welding the sleeve 5 to the tube 1. The sleeve 5 is swaged, spun, expanded mechanically or by explosives, or machined so that there is sufficient annular clearance between the tube 1 and the sleeve 5 to effectuate a weld therebetween, while other portions of the sleeve 5 are so made to only provide sufficient clearance to allow a free sliding fit between the sleeve 5 and the tube 1. Thus, the sleeve 5 is formed to have smaller outside diameter portions in those areas in which explosive welds are to be made and formed to have larger outside diameter portions, which are only slightly smaller than the inside diameter of the tube 1, in those areas which are not to be explosively expanded into engagement with the tube 1, and also in those areas where the tube 1 is to be expanded into engagement with the tube sheet 3.

Disposed within the sleeve 5 is an insert 13 formed from a resilient material such as polyethylene and sized to fit snugly within portions of the sleeve 5. The insert 13 has a central bore 15, which extends axially therethrough. Each end of the insert 13 is counterbored to form a relatively large diameter cylindrical chamber 17 adjacent each end of the insert 13. A plug 18 or other means is utilized to position the chambers 17 a short distance from the ends of the insert. The central bore 15 forms a smaller diameter cylindrical chamber in communication with the larger diameter cylindrical chambers 17. The insert 13 is shown to flare with the sleeve 5; however, while providing a flare in the insert 13 is the preferred embodiment, it is recognized that a straight insert may be utilized.

Explosive material is disposed in the chambers 17 and 17; the amount, type and configuration of the explosive material cooperates with the amount of confinement of the explosive material to produce the energy level or expansion forces required to perform the desired expansion of the sleeve 5 and tube 1.

In FIG. 1, bulk explosive 19, in granular or other form, is placed within the large cylindrical chamber 17 and an explosive cord 21 is placed within the central bore 15 between the chambers 17 so that there is physical contact between the bulk explosive 19 and the explosive cord 21. A primer or detonating cord 23 is disposed in the end of the insert 13 adjacent the flared end 9 of the sleeve 5 and a detonating device (not shown) is attached to the detonating cord 23 to initiate detonation of the explosive materials 19 and 21. The energy produced by the explosive materials 19 and 21 expands the sleeve 5 with sufficient force and velocity adjacent the large cylindrical chamber 17 to explosively weld the sleeve 5 to the tube 1 and to expand the sleeve 5 into engagement with the tube 1 in the area adjacent the bore 15. Thus, rapidly installing a sleeve 5 in a tube sheet 3 and forming explosive welds on opposite ends of the sleeve providing a metallurgical bond between the sleeve and the tube and producing a seal at these locations. These explosive welds are generally made in those portions of the sleeve 5 fitting wholely within the tube sheet 3, as the force required to form an explosive weld between the sleeve 5 and the tube 1 would deform a thin-walled tube, if the tube sheet 3 or some other backup were not disposed immediately behind the tube 1 to absorb much of the energy applied, to the tube 1 via the sleeve 5.

Figure 3:
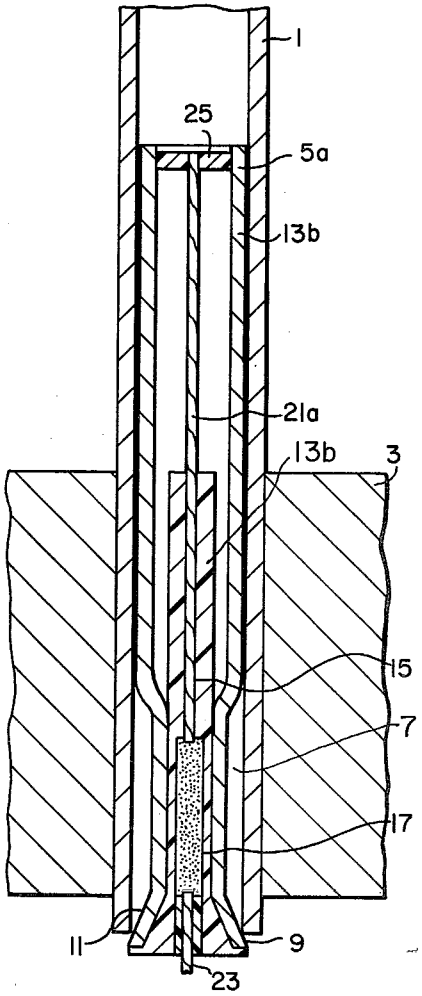
FIGS. 2 and 3 are partial sectional views of sleeves showing alternate arrangements of inserts and explosive charges.
Figure 2:
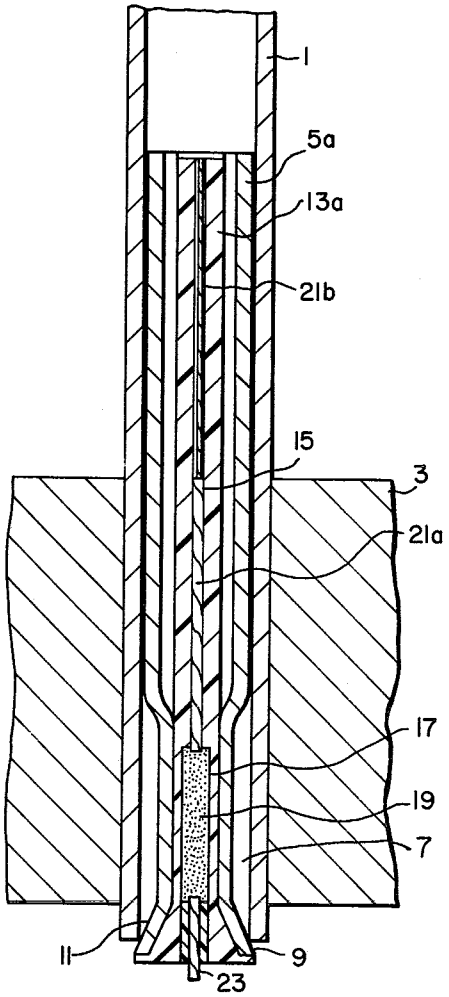

FIGS. 2 and 3 show sleeves 5*a* which extend beyond the tube sheet 3 and combinations of explosive inserts 13*a* and *b* and confinement of the explosives to effectively install such tubes utilizing explosive expansion of the sleeves 5*a* into engagement with the tubes 1 and explosive welding of the flared end of the sleeves 5*a* to the tubes 1.

The insert 13*a*, as shown in FIG. 2, has a central bore 15 and a large cylindrical chamber 17 adjacent the flared end of the sleeve 5*a*. Bulk explosive 19 is disposed within the large cylindrical chamber 17 and explosive cords 21*a* and 21*b* are disposed within the central bore 15. The explosive cord 21*b* is a cord which produces a lower energy level than the cord 21*a*. The explosive cords 21*a* and 21*b* are in physical engagement. A heat shrink membrane or other means may be utilized to hold the explosive cords 21*a* and 21*b* in an abutting relationship. The bulk explosive material 19 is in physical contact with the primer cord 23 and with the explosive cord 21*a*. Thus, by detonating the primer cord 23, the explosive materials within the insert 13*a* are detonated to explosively weld that portion of the sleeve 5*a* adjacent the large cylindrical chamber 17 to the tube 1, explosively expand that portion of the sleeve 5*a* containing the explosive cord 21*a* into engagement with the tube 1 and with sufficient force to expand the tube into engagement with the tube sheet and, finally, to expand that portion of the sleeve 5*a* adjacent the explosive cord 21*b* into engagement with the tube 1 with a minimum amount of expansion forces being transmitted into the tube 1 so that the amount of expansion of the tube 1 is minimal.

When the sleeve 5 is not being utilized to repair a leaking tube 1, a liquid such as water may be left in or added to the shell side of the heat exchanger to back up the tube 1, whereby heavier explosive charges may be employed to compensate for sleeve 5 or tube 1 eccentricity or to allow explosive welding beyond the tube sheet 3. The liquid may also prevent expansion of tubes 1 which are not expanded into engagement with the full length of tube sheet hole, and thereby prevent the entrapment of undesirable material between the tube 1 and the tube sheet 3.

As shown in FIG. 3, the sleeve 5*a* extends beyond the tube sheet 3 and has an insert 13*b*, which extends from the flared end of the sleeve 5*a* to the end of the tube sheet 3, whereby that portion of the sleeve beyond the tube sheet does not contain the insert 13*b*.

The insert 13*b* has a central bore 15 and a large cylindrical chamber 17 adjacent the flared end 9 of the sleeve 5*a*. Bulk explosive 19 is disposed in the large cylindrical chamber 17 and an explosive cord 21*a* is disposed in the central bore 15. The explosive cord 21*a* extends through the bore 15 and to the end of the sleeve 5*a* opposite the flared end. A wafer 25 supports the end of the explosive cord 21*a* and positions it axially within the sleeve 5*a*.

Upon detonation, that portion of the sleeve 5*a* adjacent the large cylindrical chamber 17 is expanded into engagement with the tube and explosively welded thereto, that portion of the sleeve 5*a* adjacent the bore 15 is expanded into engagement with the tube 1 and the tube 1 is expanded into engagement with the tube sheet 3. That portion of the sleeve 5*a* beyond the insert 13*b* and tube sheet 3 is expanded into engagement with the tube 1 in such a manner that there is a minimal amount of expansion of the tube 1, the difference in the expansion forces being caused by the confinement of the explosive cord 21*a* in the insert in the area adjacent the tube sheet and the free area adjacent the explosive cord 21*a* beyond the tube sheet.

After the completion of this explosive expansion, there is no metallurgical bond between the end of the sleeve 5*a* opposite the flared end 9 and the tube 1, since that end of the sleeve 5*a* was only expanded into engagement with the tube 1. To effectuate a seal on that end of the sleeve 5*a*, heat is applied to the inside of the sleeve 5*a* to weld or braze the sleeve 5*a* to form a metallurgical bond and seal between the tube 1 and the sleeve 5*a*. Heat may be applied by an arc, induction electrical heating, an acetylene flame or other means, the amount depending on the type of metallurgical bond desired. The preferred embodiment for the sleeves 5*a* in FIGS. 2 and 3 is an arc welding process with a non-consumable electrode and an inert gas shield.

Figure 5:
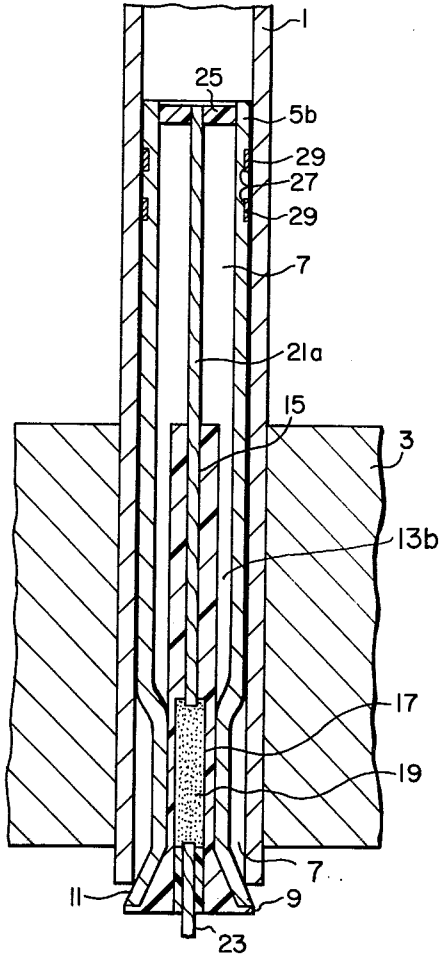
FIGS. 4–7 are partial, sectional views of sleeves showing girth bands of brazing material and alternate arrangements for the disposition of the girth bands and explosive charges.
Figure 4:
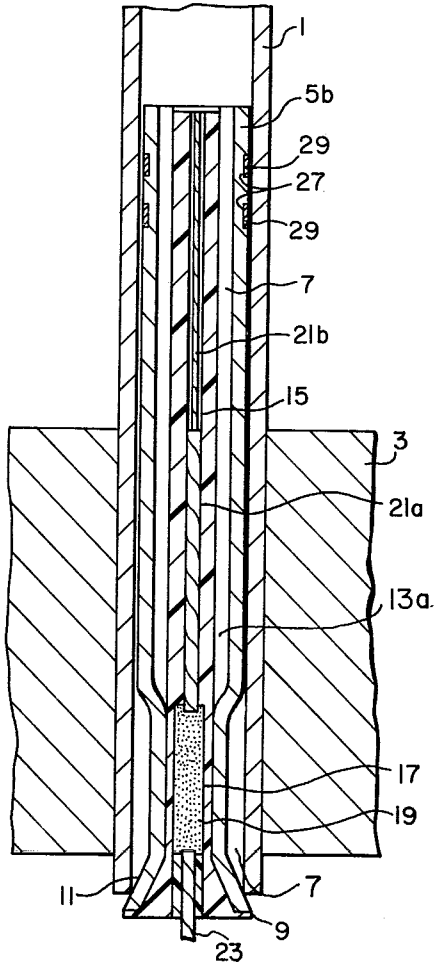

FIGS. 4 and 5 show sleeves 5*b*, which extend beyond the tube sheet 3 and have a pair of spaced-apart, circumferential or girth-wise grooves 27 disposed in the outer surface of the sleeves 5*b* adjacent the end opposite the flared end 9. The grooves 27 are filled with a brazing material 29.

The inserts 13*a* and 13*b*, shown in FIGS. 4 and 5, are duplicates of the inserts 13*a* and 13*b*, respectively, in FIGS. 2 and 3 and, when detonated, the explosive material expands the sleeves 5*b* in the same manner as the explosive materials in the inserts 13*a* and 13*b* in FIGS. 2 and 3 expanded the sleeves 5*a*. The difference in the embodiments is the ends of the sleeves 5*b* opposite the flared end 9 are heated by an acetylene flame or induction heating to melt the brazing material 29 in the grooves 27 and form a metallurgical bond and seal between the ends of the sleeve 5*b* and the tube 1 by a brazing technique, which is utilized after the sleeves 5*b* have been explosively expanded into engagement with the tubes 1.

Figure 7:
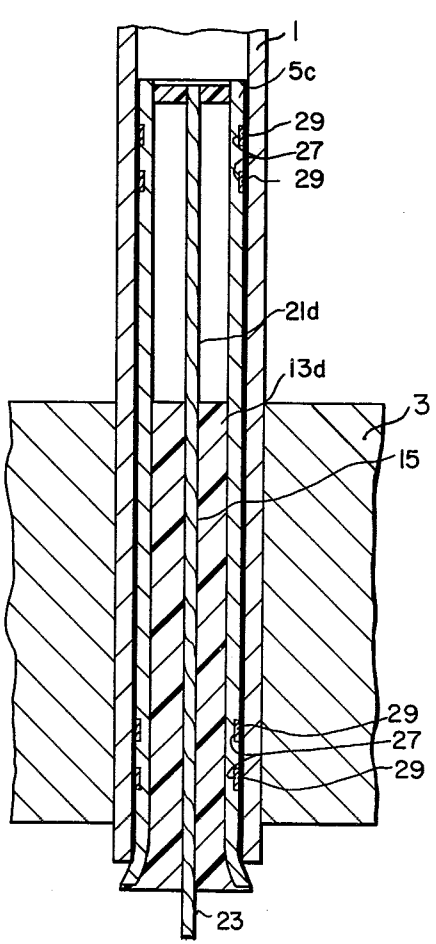
Figure 6:
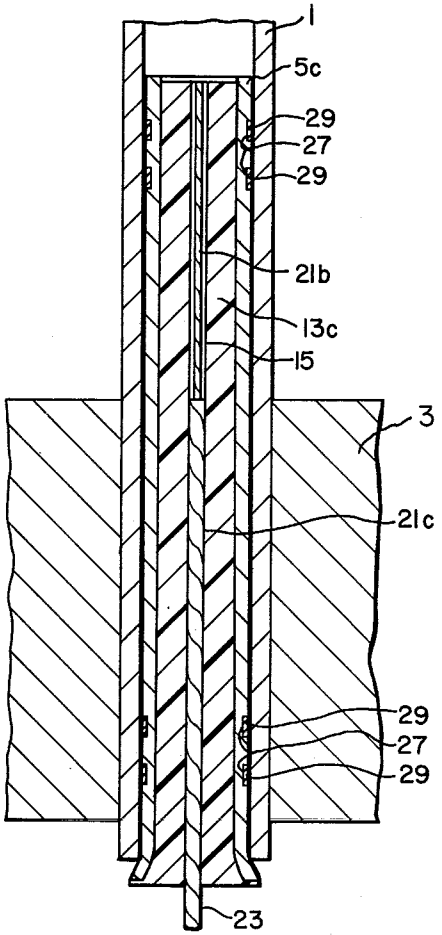

FIGS. 6 and 7 show sleeves 5*c* which extend beyond the tube sheet 3 and have a pair of spaced-apart circumferential or girth-wise grooves 27 disposed in the outer surface of the sleeves 5*c* adjacent both ends thereof. The grooves 27 are filled with brazing material 29. The insert 13*c* shown in FIG. 6 has a centrally disposed bore 15 extending therethrough and an explosive cord 21*c* disposed in the bore 15 so that it is co-extensive with the tube sheet. Also disposed in the bore 15 and in physical contact with the explosive cord 21*c* is explosive cord 21*b*, which is a lower energy cord. A heat shrink membrane or other means may be utilized to maintain the physical contact between the explosive cords 21*b* and 21*c*.

A primer cord 23 is disposed in the bore 15 in physical contact with the explosive cord 21*c* so that when detonated, the explosive cords 21*c* and 21*b* expand the sleeve 5*c* into engagement with the tube 1, in such a manner that the portion of the sleeve 5*c* co-extensive with the tube sheet 3 receives a greater explosive force than the portion of the sleeve 5*c* beyond the tube sheet 3; however, the explosive foces applied are not sufficient to explosively weld the sleeve 5*c* to the tube 1 even in that portion of the tube 1 within the tube sheet 3. Thus, to form a seal and metallurgical bond between the sleeve 5*c* and the tube 1, the ends of the sleeve 5*c* are heated, utilizing an acetylene flame or electrical induction heating, the heat applied being the amount necessary to melt the brazing material 29 and form a metallurgical bond between the sleeve 5*c* and the tube 1 and thus form a seal at each end of the sleeve 5*c*.

Irrespective of the type of metallurgical bond desired, brazing, welding, or explosive welding, it is required that the area of the tube 1 in which the metallurgical bond is to be effectuated be cleaned sufficiently to remove corrosion products and other foreign material in order to produce a metallurgical bond and good seal between the sleeve and the tube 1.

The insert 13*d*, shown in FIG. 7, has a centrally disposed bore 15 extending therethrough and the insert extends from the flared end 9 of the sleeve 5*c* to the inner edge of the tube sheet 3.

An explosive cord 21*d* extends from the edge of the tube sheet adjacent the flared end of the sleeve 5*c* through the remainder of the sleeve 5*c* and to the end of the sleeve 5*c* opposite the flared end, where there is a wafer 25, which receives and positions the cord 21*b* along the axis of the sleeve 5*c*.

A primer cord 23 is disposed in physical contact with the explosive cord 21*d* so that, upon detonation, the explosive cord 21*d* explosively expands the sleeve 5*c* into engagement with the tube 1 exerting greater explosive forces in that area of the sleeve coextensive with the tube sheet than it does in that area of the sleeve 53 beyond the tube sheet 3 to effectively expand the sleeve 5*c* into engagement with the tube 1.

Heat is applied to both ends of the expanded sleeve 5*c* adjacent the grooves 27 to form a metallurgical bond and seal between the sleeve 5*c* and tube 1.

Figure 8:
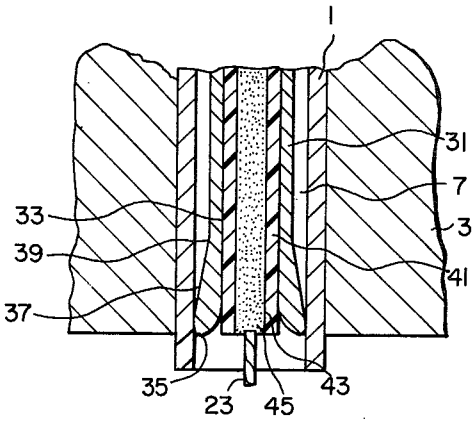
FIG. 8 is a partial sectional view of an orifice sleeve showing an insert and the disposition of an explosive charge disposed therein.

FIG. 8 shows a sleeve 31 which, when expanded into engagement with the tube 1, forms an orifice for controlling the flow through the tube 1. The sleeve 31 has a cylindrical bore 33 which extends therethrough; one end of the sleeve 31 is counterbored to produce a smooth radius 35 extending from the outer surface to the bore 33. The outer surface of the sleeve 31 is tapered inwardly from a diameter substantially equal to the inner diameter of the tube 1, the origin of the base of the taper being generally at the outer edge of the counterbore. The taper extends approximately midway along the sleeve 31 forming a frustoconical portion 37, and the remainder of the outer surface is generally cylindrical, forming a cylindrical portion 39.

Figure 9:
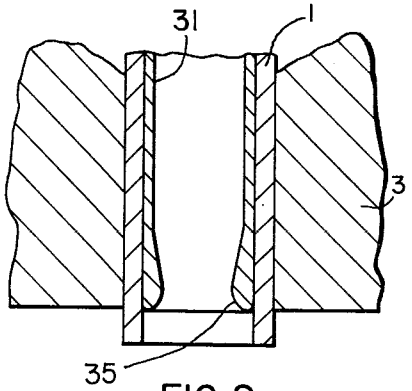
FIG. 9 is a partial sectional view showing an orifice sleeve after it has been explosively expanded into engagement with a tube.

Disposed in the bore 33 is an insert 41 formed from a resilient material, such as polyethylene. The insert 41 has a centrally disposed bore 43 and an explosive 45 is disposed within the bore 43. A primer or detonating cord 23 is disposed to physically contact the explosive 45 and upon detonation, the sleeve 31 is explosively expanded into engagement with the tube 1. The taper and space between the cylindrical portion 39 and the tube 1 cooperate with the explosive expansion to explosively weld the sleeve 31 in place in the tube 1 and form a metallurgical bond and seal therebetween to permanently install the orifice sleeve 31 in the tube 1, as shown in FIG. 9.

The utilization of the explosive charges, inserts and sleeves hereinbefore described facilitates the installation of sleeves in the tube to repair a defective tube, lower the heat flux through the tube wall in that portion of the tube by increasing the effective tube wall thickness and controlling the fluid velocity in the tube by restricting or forming an orifice in the mouth of the tube.

What is claimed is:

1. The method of installing a sleeve in one end of a tube disposed in a tube sheet of a heat exchanger, said method comprising the steps of:

forming the sleeve so that it has an outer diameter suficiently smaller than the inner diameter of the tube to provide an annular space therebetween, flaring one end of the sleeve to such an extent that the flared end is larger in diameter than the inside diameter of the tube, inserting the sleeve in the one end of the tube so that the flared end wedges itself against the tube to position the sleeve in the tube and form an annular space therebetween, forming an insert of resilient material so that it fits snugly within the sleeve and has a relatively large diameter cylindrical chamber disposed adjacent the flared end of the sleeve and a smaller diameter cylindrical chamber extending from the larger diameter cylindrical chamber and away from the flared end of the sleeve, placing explosive material in the chambers, and detonating the explosive materials, whereby the flanged end of the sleeve is explosively welded to the tube and the sleeve adjacent the smaller diameter cylindrical chamber is explosively expanded into engagement with the tube, and forming a metallurgical bond between the end of the sleeve opposite the flared end and the tube.

2. The method set forth in claim 1 wherein the step of forming the metallurgical bond includes heating the end of the sleeve to effectuate such a bond.

3. The method set forth in claim 1, wherein the step of forming a metallurgical bond includes forming the insert with a second large diameter chamber adjacent the end of the sleeve opposite the flared end so that it is in communication with the smaller diameter cylindrical chamber and placing explosive material in the second large cylindrical chamber, whereby after detonation, the end of the sleeve opposite the flared end is explosively welded to the tube.

4. The method set forth in claim 1, wherein the step of forming a metallurgical bond includes welding the end of the sleeve opposite the flared end to the tube.

5. The method set forth in claim 1, wherein the step of forming the sleeve includes forming at least one groove in the outer surface of the sleeve adjacent the end opposite the flared end and filling the groove with a brazing material and the step of forming a metallurgical bond includes heating the end of the tube opposite the flared end sufficiently to effectuate a brazed joint between the tube and the sleeve.

6. The method set forth in claim 1, wherein the step of forming the sleeve comprises forming a plurality of grooves in the outer diameter of the sleeve adjacent the end of the sleeve opposite the flared end, filling the grooves with a brazing material and the step of forming a metallurgical bond includes heating the end of the sleeve opposite the flared end sufficiently to effectuate a brazed joint between the sleeve and the tube.

7. The method set forth in claim 1, wherein the step of forming the sleeve comprises making it sufficiently long so that when wedged into the tube, the end opposite the flared end extends beyond the tube sheet and the smaller cylindrical chamber contains explosive material of two different energy levels, the explosive material having the greater energy level being disposed in that portion of the smaller chamber which is adjacent the tube sheet and the explosive material having the lesser energy level being disposed in that portion of the smaller cylindrical chamber which is beyond the tube sheet, whereby when detonated, the sleeve is expanded into engagement with the tube in the area adjacent the tube sheet with sufficient energy to expand the tube into engagement with the tube sheet and the sleeve is expanded into engagement with that portion of the tube beyond the tube sheet with a minimal amount of energy whereby the expansion of the tube beyond the tube sheet is minimal.

8. The method set forth in claim 1, wherein the step of forming the sleeve includes forming the sleeve so that it extends beyond the tube sheet when the flared end of the sleeve is wedged into the tube, the step of forming the insert includes forming the insert so that it only extends into that portion of the sleeve adjacent the tube sheet and the explosive material in the smaller chamber is an explosive cord which extends through the smaller chamber and to the end of the sleeve opposite the flared end whereby the sleeve is exploded into engagement with the tube adjacent the tube sheet with sufficient energy to expand the tube into engagement with the tube sheet and the sleeve is expanded into engagement with that portion of the tube beyond the tube sheet with a minimum amount of energy, whereby the expansion of the tube beyond the tube sheet is minimal.

9. The method set forth in claim 7, wherein the step of forming the sleeve includes machining at least one groove in the outer surface of the sleeve adjacent the end opposite the flared end and filling the groove with a brazing material and the step of forming the metallurgical bond includes heating the end of the tube opposite the flared end sufficiently to effectuate a brazed joint between the tube and the sleeve.

10. The method set forth in claim 8, wherein the step of forming the sleeve includes at least one groove in the outer surface of the sleeve adjacent the end opposite the flared end and filling the groove with a brazing material and the step of forming a metallurgical bond includes heating the end of the tube opposite the flared end sufficiently to effectuate a brazed joint between the tube and the sleeve.

11. A method of installing a sleeve in one end of a tube disposed in a tube sheet of a heat exchanger, said method comprising the steps of:

forming the sleeve so that it has an outside diameter sufficiently smaller than the inside diameter of the tube to provide an annular space therebetween, flaring one end of the sleeve to such an extent that the flared end is larger in diameter than the inside diameter of the tube, inserting the sleeve into the one end of the tube so that the flared end wedges itself against the tube to position the sleeve in the tube and to form an annular space therebetween, forming the sleeve sufficiently long to extend beyond the tube sheet when the flared end is wedged against the tube, forming an insert so that it fits snugly into the sleeve and has a centrally disposed bore extending therethrough, placing explosive materials which produce two different energy levels in the bore, the explosive material producing the greater energy level being placed in that portion of the bore adjacent the tube sheet and the explosive material producing the lesser energy level being placed in that portion of the bore which extends beyond the tube sheet, whereby when detonated, the sleeve is expanded into engagement with the tube in the area adjacent the tube sheet with sufficient energy to expand the tube into contact with the tube sheet and the sleeve is expanded into engagement with that portion of the tube beyond the tube sheet with a minimum amount of energy whereby the expansion of the tube beyond the tube sheet is minimal, and, forming a metallurgical bond between the end of the sleeve opposite the flared end and the tube.

12. The method set forth in claim 11, wherein the step of forming a metallurgical bond includes heating the end of the sleeve to effectuate such a bond.

13. The method set forth in claim 11, wherein the step of forming a metallurgical bond includes welding the end of the sleeve to the tube.

14. The method set forth in claim 11, wherein the step of forming the sleeve includes machining at least one groove in the outer surface of the sleeve adjacent the end opposite the flanged end and filling the groove with a brazing material and the step of forming the metallurgical bond includes heating the end of the tube opposite the flared end sufficiently to effectuate a brazed joint between the tube and the sleeve.

15. The method of installing a sleeve in one end of a tube disposed in a tube sheet of a heat exchanger, said method comprising the steps of:

forming the sleeve so that is has an outside diameter sufficiently smaller than the inside diameter of the tube to provide an annular space therebetween, flaring one end of the sleeve to such an extent that the flared end is larger in diameter than the inside diameter of the tube, inserting the sleeve in the one end of the tube so that the flared end wedges itself against the tube to position the sleeve in the tube and to form an annular space therebetween, forming the sleeve sufficiently long to extend beyond the tube sheet when the flared end is wedged against the tube, forming an insert so that its fits snugly within the sleeve and is generally coextensive with the tube sheet and has a centrally disposed bore extending therethrough, placing an explosive cord in the bore of the insert, the explosive cord being sufficiently long to extend beyond the insert generally to the end of the sleeve opposite the flared end, detonating the explosive cord whereby the sleeve is expanded into engagement with the tube in the area adjacent the tube sheet with sufficient energy to expand the tube into engagement with the tube sheet and the sleeve is expanded into engagement with that portion of the tube beyond the tube sheet with a minimum amount of energy whereby the expansion of the tube beyond the tube sheet is minimal, and forming a metallurgical bond between the ends of the sleeve and the tube.

16. The method set forth in claim 15, wherein the step of forming metallurgical bonds includes heating the ends of the sleeve to effectuate such bonds.

17. The method set forth in claim 15, wherein the step of forming metallurgical bonds includes welding the ends of the sleeve to the tube.

18. The method set forth in claim 15, wherein the step of forming the sleeve includes forming at least one groove in the outer surface of the sleeve adjacent each end and filling the groove with a brazing material and the step of forming a metallurgical bond includes heating the ends of the sleeve sufficiently to effectuate a brazed joint at each end of the tube between the tube and the sleeve.

* * * * *